US010010152B2

(12) United States Patent
Chan

(10) Patent No.: US 10,010,152 B2
(45) Date of Patent: Jul. 3, 2018

(54) BUILT-IN SCRAPING DEVICE FOR COSMETIC CONTAINER

(71) Applicant: Lin-Lang Chan, Taichung (TW)

(72) Inventor: Lin-Lang Chan, Taichung (TW)

(73) Assignee: SHP (HK) TRADING LIMITED, Hong Kong (HK)

( * ) Notice: Subject to any disclaimer, the term of this patent is extended or adjusted under 35 U.S.C. 154(b) by 0 days.

(21) Appl. No.: 15/287,723

(22) Filed: Oct. 6, 2016

(65) Prior Publication Data

US 2017/0105506 A1 Apr. 20, 2017

(30) Foreign Application Priority Data

Oct. 14, 2015 (TW) ..... 104133633 A

(51) Int. Cl.

| | |
|---|---|
| ***A46B 17/08*** | (2006.01) |
| ***A45D 34/04*** | (2006.01) |
| ***A45D 40/26*** | (2006.01) |
| *A45D 34/00* | (2006.01) |

(52) U.S. Cl.

CPC ..... *A45D 34/046* (2013.01); *A45D 40/267* (2013.01); *A45D 2034/002* (2013.01); *A45D 2200/1072* (2013.01); *A46B 2200/1053* (2013.01)

(58) Field of Classification Search

CPC ..... A45D 40/267; A46B 2200/1053

USPC ..... 401/121, 122

See application file for complete search history.

(56) References Cited

U.S. PATENT DOCUMENTS

| | | | | |
|---|---|---|---|---|
| 6,082,918 A * | 7/2000 | Gueret | A45D 33/00 | 401/126 |
| 6,568,405 B2 * | 5/2003 | Masuyama | A45D 34/046 | 132/218 |
| 7,824,121 B2 * | 11/2010 | Ramet | A45D 34/046 | 401/118 |
| 8,152,399 B2 * | 4/2012 | Lasfargues | A45D 40/267 | 132/218 |

FOREIGN PATENT DOCUMENTS

KR 20130012946 A * 2/2013

* cited by examiner

*Primary Examiner* — Jennifer C Chiang
(74) *Attorney, Agent, or Firm* — Leong C. Lei

(57) ABSTRACT

A built-in material scraping device for a cosmetic container is a material scraping device capable of being slipped downward with a liquid surface of liquid material stored inside the cosmetic container. An elastic piston piece is mainly into the container before a scraping element is installed on the mouth of the container, where a through hole is configured on the center of the piston piece, having a diameter equal to the diameter of a brushing rod, which is passed through the through hole to press the piston piece downward to move the stored liquid material to flow downward, thereby being convenient for the soaking of the brush head upon make-up use.

4 Claims, 5 Drawing Sheets

BUILT-IN SCRAPING DEVICE FOR COSMETIC CONTAINER

(a) TECHNICAL FIELD OF THE INVENTION

The present invention relates to a built-in scraping device for a cosmetic container, allowing liquid material filled in cosmetics packing container to be kept in a highly full like state any time, convenient for soaking, attaching and thus getting ort liquid material accurately.

(b) DESCRIPTION OF THE PRIOR ART

Containers for packing cosmetics such as eyeliner, mascara or lipstick are generally designed into long tube-typed bottles, for example, a mascara bottle set disclosed in Taiwan Patent No. M463534, where the hollow internal space therein is allowed for the filling-in of cosmetic liquid material; the brush rod in connection with the cover and the eyelash brush extended from one end thereof are inserted in the bottle container directly upon the closing of the bottle mouth for the storage thereof or material soaking, getting. Upon the getting-out of the liquid material stored inside the container bottle, it will flow and the liquid level thereof will be changed relatively to the inclined angle of the container bottle when it is held actually; the eyelash brush can soak the material indeed at will after being inserted in the container bottle when liquid material is filled up, but it cannot soak the liquid material accurately when the liquid material left in the bottle is less than half the capacity because the liquid level is changed and the fluid material flows continuously to the lower edge of the bottle with the holding gesture and because the inserted brush head is generally positioned at the center of the inside of the bottle. Especially, this inaccurate soaking is more obvious when the stored material is much more less. In addition, much residual liquid material will be adhered to the internal surface of the bottle after use, resulting in the waste of the liquid material, and further forming the inconvenience and embarrassment of the recycling processing of the bottle.

SUMMARY OF THE INVENTION

To overcome the defects mentioned above, to allow the easiness of the liquid material soaking and convenience for scraping and cleaning liquid material attached to the inner surface of the container, and to conform to environmental protection requirements, the present invention is proposed. A built-in material scraping device for a cosmetic container according to the present invention is configuring a soft elastic piston piece directly in a long-tube type container, inserting a cosmetic tool in the container to press the piston piece downward to scrape the material attached to the inner surface of the container, allowing the liquid material to be centralized and kept in a state similar to full filling, and scraping the inner surface of the container effectively without residual liquid material left.

The main object of the present invention is to provide a built-in scraping device for a cosmetic container, installing directly in a cosmetic liquid storage container with a soft elastic piston piece, which is in a slightly tight fir with the inner surface of the container and pressed by a brush rod of a cosmetic tool inserted in the container to scrape the inner face of the container to gather the liquid material to form it in a state similar to full filling, thereby allowing the accuracy and convenience of material soaking of the cosmetic tool upon make-up.

DETAILED DESCRIPTION OF THE PREFERRED EMBODIMENTS

Figure 1:
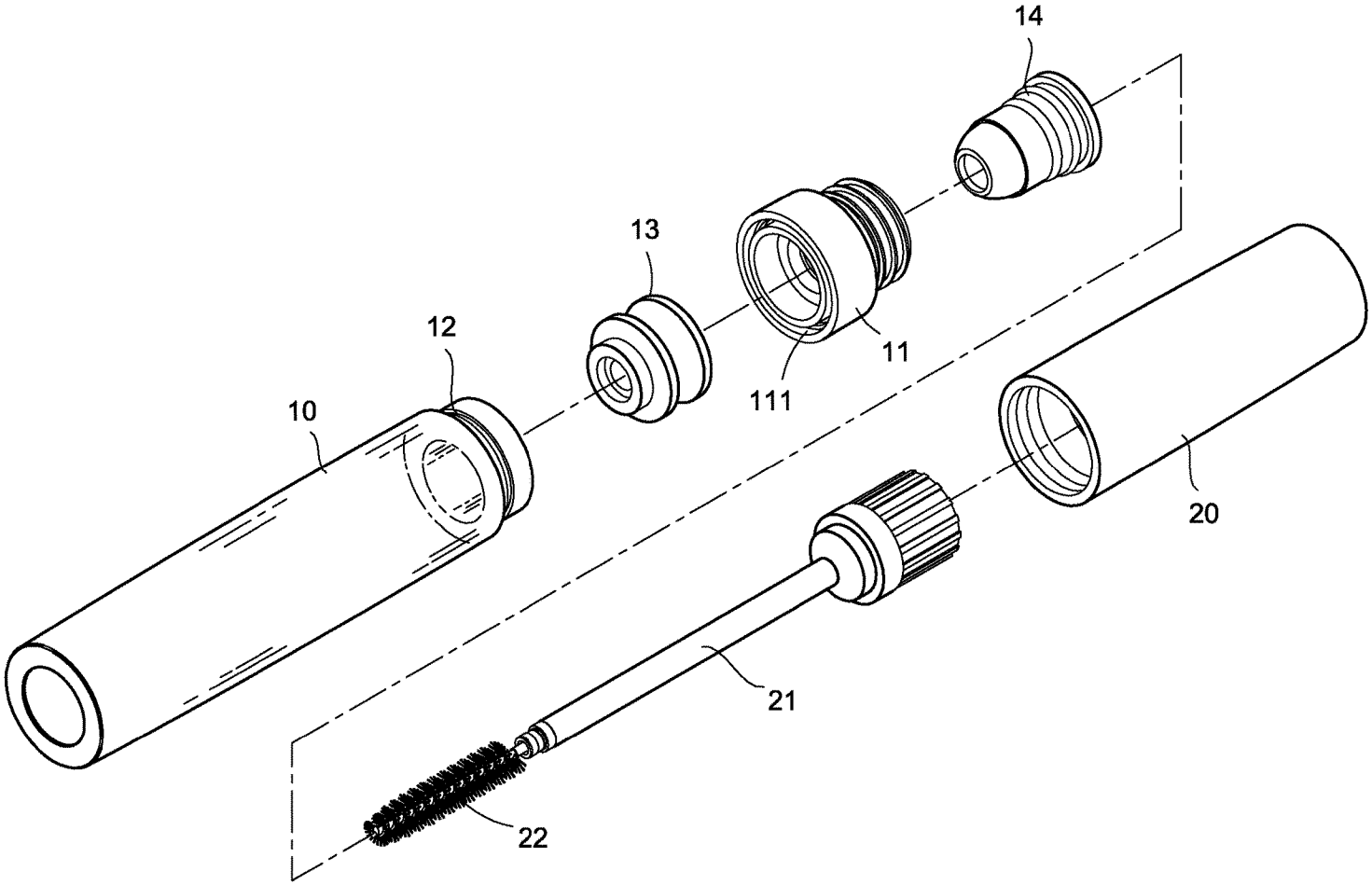
FIG. 1 is an exploded view of a cosmetic container according to the present invention.
Figure 2:
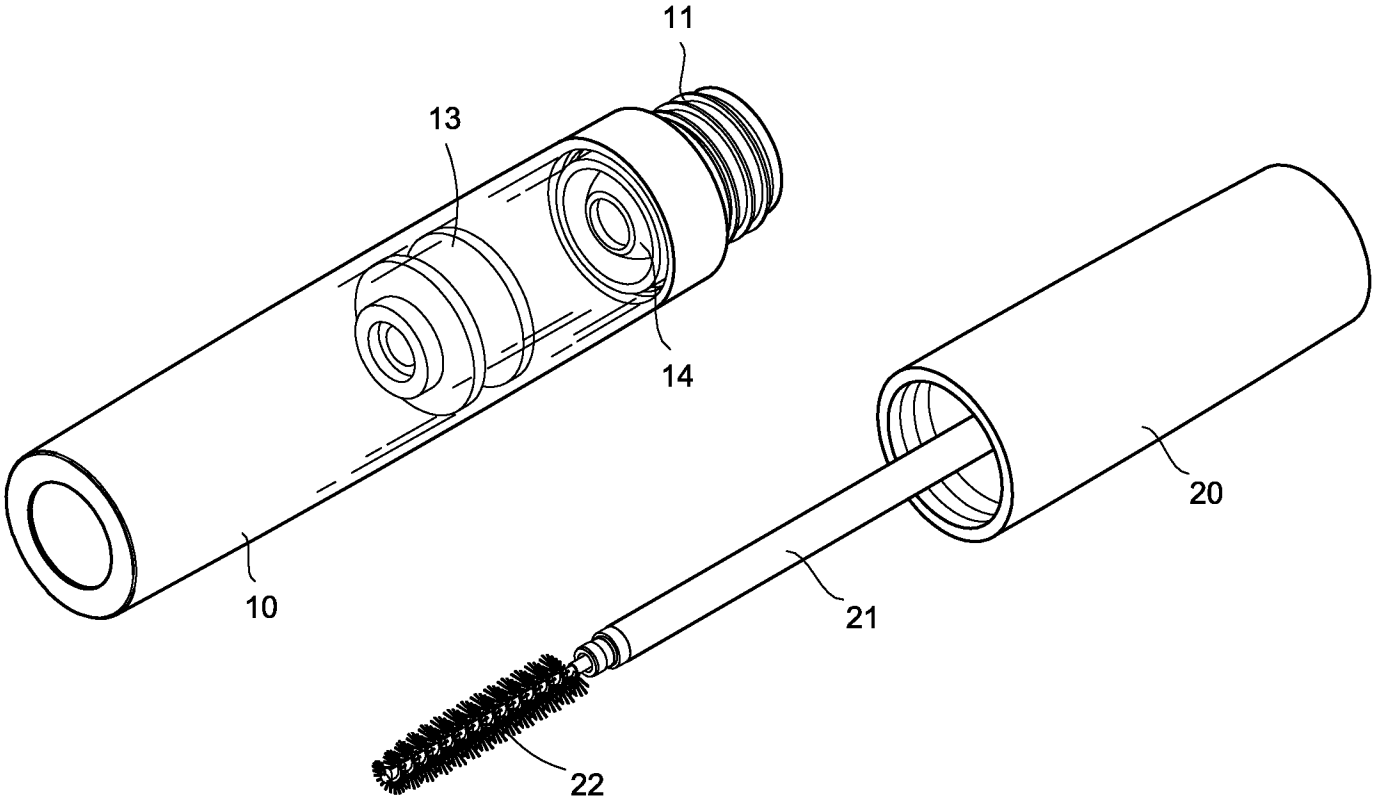
FIG. 2 is a perspective view of the cosmetic container according to the present invention, where the cosmetic container is partly assembled.
Figure 3:
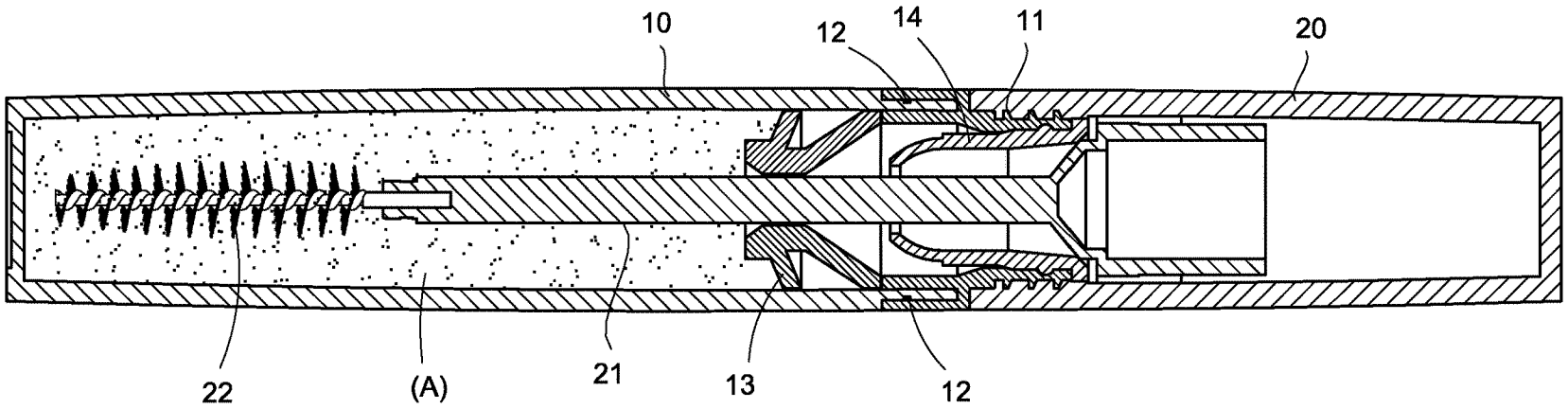
FIG. 3 is a cross-sectional view of the cosmetic container of the present invention.
Figure 4:
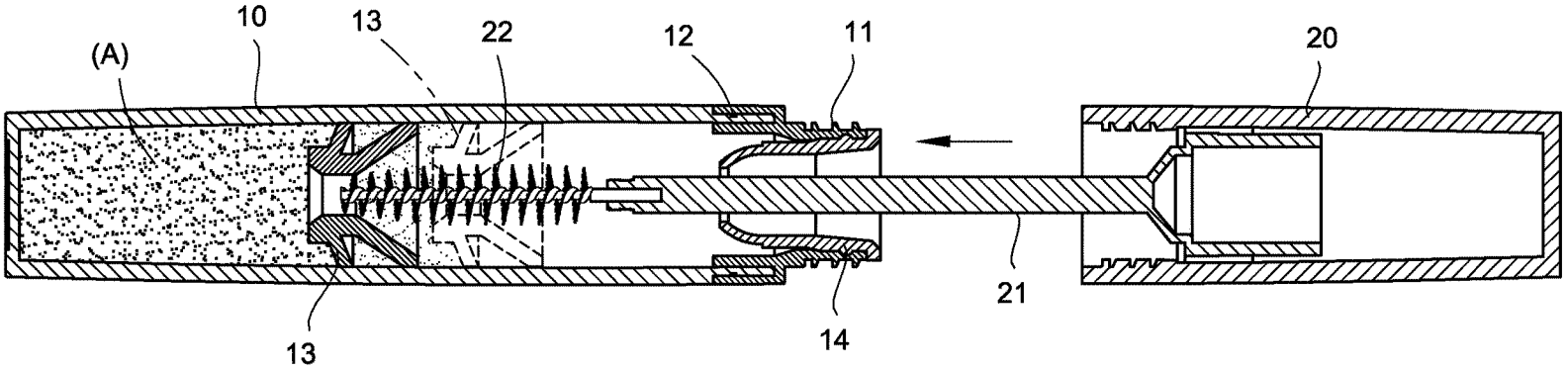
FIG. 4 is a cross-sectional view of an eyelash brush inserted in the cosmetic container according to the present invention upon the storage thereof or the insertion thereof in the container to move a piston piece to scrape the inner surface of the container and soak liquid material stored therein.
Figure 5:
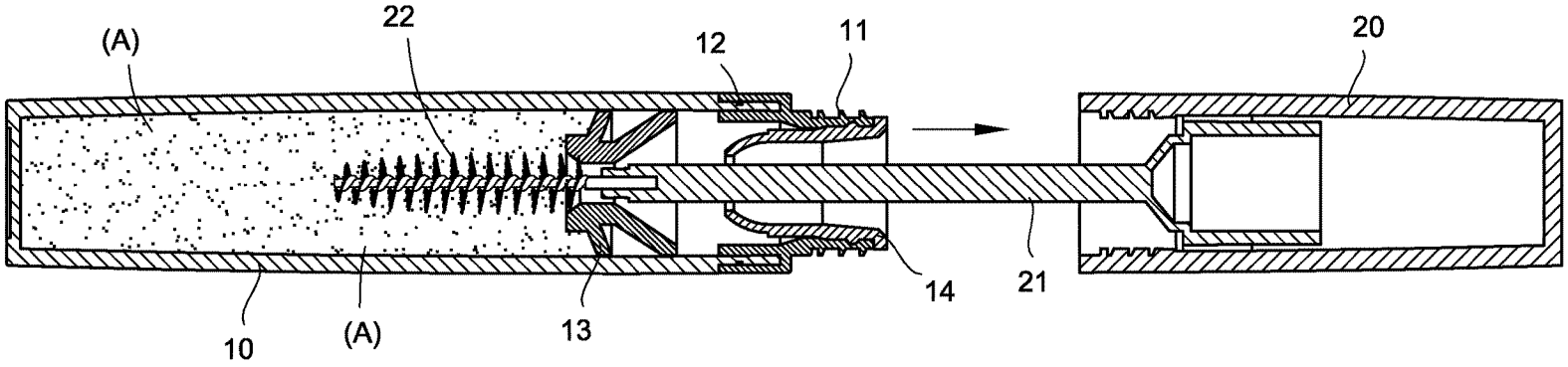
FIG. 5 is a cross-sectional view of the cosmetic container of the present invention upon the drawing-out of the eyelash brush.

A built-in material scraping device for a cosmetic container is a device for automatic material scraping and liquid material storage concentration to prevent the material adhesion to the inner surface of a cosmetic container for the storage of cosmetic liquid material, which may be inserted with a cosmetic tool such as eyelash pen, eyeliner or lip gloss, providing the material soaking and getting convenience, safety and accuracy of the cosmetic tool upon make-up use. Referring to FIGS. 1 to 6 and taking a general eyelash brush cosmetic tool as an example to describe, the whole cosmetic tool includes a container body 10 for the storage of eyelash cosmetic liquid material, the appearance of which is approximately close to the one of a conventional container, being a hollow long tube-typed body with a thin thickness, in which cosmetic liquid material is filled, where a concave stepped edge is configured on the top end of the container body 10 for the engagement with an inverted U-shaped insertion groove 111 formed on the bottom end of a mouth piece 11, which can be constituted simply and accurately into a filling mouth with a leakproof ring 12/ Furthermore, a piston piece 13 is inserted into the container through the top end thereof from the outside of the container body 10 before the mouth piece 11 is engaged therewith, the outer diameter of the piston piece 13 being equal to the inner diameter of the tubal container body 10, where the piston piece 13 is made of elastic material, which generally is nitrile butadiene rubber (NBR), capable of being in exact engagement with the inner surface of the container after being inserted in the container body 10. Furthermore, a through hole is configured on the center of the piston piece 13, and a V-shaped mouth expansion is formed on the top thereof, where the V-shape mouth expansion and an annular edge on the bottom of the piston piece 13 are formed into an scraping face of upper and lower layers pressing against the inner face of the container; the scraping face can expand naturally into upper and lower annular edges pressing against the inner face of the container after being inserted therein, having the effects of both positioning and scraping. Furthermore, a premade U- or V-shaped scraping element 14 adapted to scrape residual material soaked on the soaking head of the cosmetic, ensuring that too many material drops will not be soaked upon make-up so as to make make-up use safe and convenient. Furthermore, a cover 20 is adapted to be in engagement with the threads on the outer surface of the mouth piece 11 at the outer edge of the mouth of the container outside the container body 10, thereby closing the container safely. In addition, the structure of the cover 20 is almost similar to the ones of conventional cosmetic tool covers, an extension rod 21 is configured on the center of the inside thereof, and the tail end of the extension rod 21 is configured with a eyelash brush head 22 or eyeliner pen head, where the diameter of the extension rod 21 is exactly the same as the one of the central through hole of the piston piece 13, allowing it to have a slightly unsmooth interference effect because of the soft elastic material of the piston piece 13, thereby allowing the extension rod 21 to press the piston piece 13 to move downward due to the micro interference of the forced insertion after the brush head 22 is inserted in and passed through the central through hole of the piston piece 13; the piston piece 13 will be pressed downward at the same time when the extension rod 21 is inserted therein when the liquid surface of the stored cosmetic liquid material (A) moves downward. Thereafter, the piston piece 13 is supported and positioned by the liquid surface when it is pushed to the liquid surface, and the extension rod 21 can then inserted into the liquid material to soak in it. It is noted here that the residual cosmetic liquid material attached to the inner face of the container will be scraped down at the same time when the piston piece 13 is moved downward because of the interference fit of the piston piece 13 and container, allowing the cosmetic liquid material to be gathered naturally and reused. In addition, the liquid material will lubricate the rod surface of the extension rod 21 naturally when the liquid material is gotten out by the extension rod 21 such that less resistance happens upon the drawing-out of the extension rod 21, which not only the rod face can be scraped clean relatively without material attachment thereto, but the piston piece 13 will not be moved upward upon the drawing-out of the extension rod 21. As to the brush head 22, the material attached to it is first scraped by the piston piece 13, and then scraped accurately by the scraping element 14 installed in the mouth on the top of the container so that the cosmetic tool can be taken out without material dropping, ensuring the safe and practical effect upon make-up use; the soft elastic piston piece 13 inserted directly in the container body 10 is operated in coordination with the cosmetic tool to scrap the inner face of the container clean and maintain the liquid surface at a contour position close to a full state after the cosmetic tool is inserted in the container, allowing the stored liquid material to look like in a newly full state. The present invention is convenient for material soaking and gathering upon make-up use, thereby preventing the stored liquid material from being wasted and ensuring recycling convenience.

Figure 6:
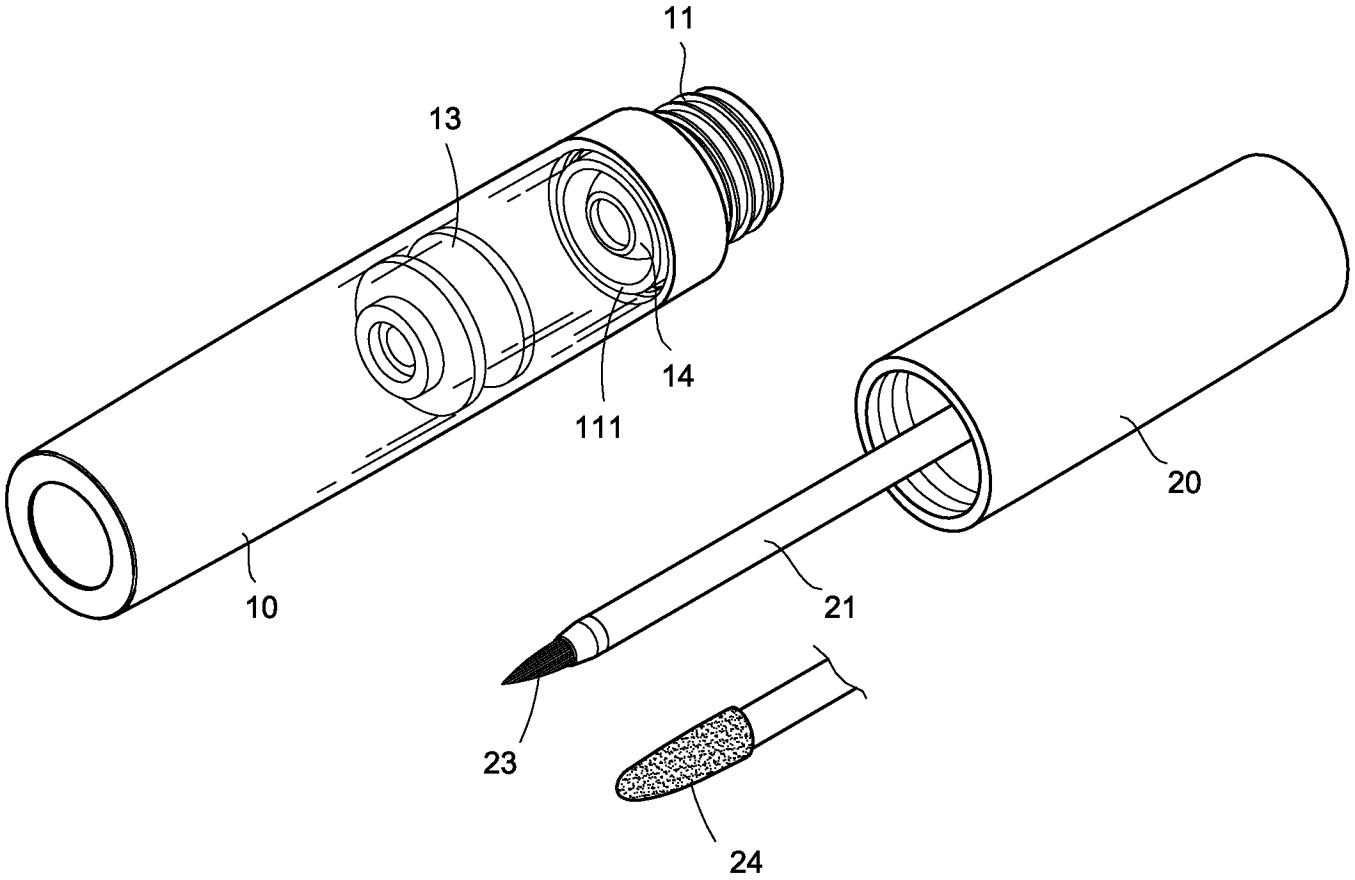
FIG. 6 is a perspective view of the present invention, where a variety of different cosmetic tools may be used.

Referring to FIG. 6, the brush head 22 may be an eyeliner head 23 or lip gloss cotton head 24 or the like, all of then can achieve the material soaking and getting convenience and material gathering benefit.

I claim:

1. A built-in material scraping device for a cosmetic container, comprising a hollow container body for the storage of cosmetic liquid material, a scraping element being installed in a mouth on a top end of said container body, a thread face allowing to be in engagement with a cover being configured on an outside of said mouth, an extension rod and brush head configured on said extension rod being inserted in a center of said cover, wherein a soft elastic piston piece is pre-installed inside said container body, a through hole is configured on a center of said piston piece, allowing said extension rod and brush head to be passed through to an inside of said container for cosmetic liquid material soaking and getting, wherein the diameter of said through hole is equal to the one of said extension rod, allowing said extension rod to push said piston piece to slide when said extension rod is passed through said through hole, thereby maintaining said liquid material in a full state and scraping an inner face of said container clean, wherein said mouth on said top of said container body is configured with a stepped edge for insertion, allowing a premade mouth piece to be inserted therein easily, and said piston piece to be placed therein conveniently.

2. The device according to claim 1, wherein a through hole is configured on a center of said piston piece, a top thereof is formed into a V-shaped mouth expansion, and a scraping face of upper and lower layers is formed on an annular rim of a bottom of said piston piece.

3. The device according to claim 1, wherein said piston piece is made of elastic material.

4. The device according to claim 3, wherein said elastic material is nitrile butadiene rubber (NBR).

* * * * *